US007793794B2

(12) United States Patent
Cho

(10) Patent No.: US 7,793,794 B2
(45) Date of Patent: Sep. 14, 2010

(54) HOIST FOR LOW SPACE CRANE

(75) Inventor: Duck-Rae Cho, Bucheon (KR)

(73) Assignee: KG Inc., Incheon (KR)

( * ) Notice: Subject to any disclaimer, the term of this patent is extended or adjusted under 35 U.S.C. 154(b) by 0 days.

(21) Appl. No.: 11/997,384

(22) PCT Filed: May 25, 2007

(86) PCT No.: PCT/KR2007/002559

§ 371 (c)(1),
(2), (4) Date: Jan. 30, 2008

(87) PCT Pub. No.: WO2008/010643

PCT Pub. Date: Jan. 24, 2008

(65) Prior Publication Data

US 2009/0114613 A1 May 7, 2009

(30) Foreign Application Priority Data

Jul. 21, 2006 (KR) ..... 10-2006-0068693

(51) Int. Cl.
*B66C 11/06* (2006.01)

(52) U.S. Cl. ..... 212/312; 212/71; 212/346

(58) Field of Classification Search ..... 212/71, 212/312, 346
See application file for complete search history.

(56) References Cited

U.S. PATENT DOCUMENTS 1,944,054 A * 1/1934 Ackerman ..... 104/247
3,223,248 A * 12/1965 Cowan ..... 212/346
3,260,508 A * 7/1966 Powell ..... 254/331
3,301,409 A * 1/1967 De Gasperis ..... 212/346
3,319,802 A * 5/1967 Osawa ..... 212/346
4,752,011 A 6/1988 Pudney

FOREIGN PATENT DOCUMENTS

DE 35 13 879 A1 * 10/1986
KR 10-2001-0098394 11/2001
KR 20-0415055 4/2006
SU 796177 B * 1/1981

OTHER PUBLICATIONS

International Search Report for PCT/KR2007/002559 dated Aug. 21, 2007.
Written Opinion for PCT/KR2007/002559 dated Aug. 21, 2007.

* cited by examiner

*Primary Examiner*—Thomas J. Brahan
(74) *Attorney, Agent, or Firm*—Kile Goekjian Reed & McManus PPLC

(57) ABSTRACT

A hoist for a low space crane is disclosed, which comprises a hoist frame in which a load point transferred to a girder is positioned at a vertical surface of one side of the girder, and a balance of a biased load is maintained for thereby decreasing an entire weight of the system, and an equal distribution unit which installed between the hoist frame and the guide rail for absorbing an impact load transferred to the hoist frame and equally distributing the entire vertical load. A buckling phenomenon does not occur at the girder even when a relatively heavy object is transferred by providing the first and second support wheel parts on the first vertical surface of the girder.

9 Claims, 9 Drawing Sheets

【Figure 1】 Prior Art
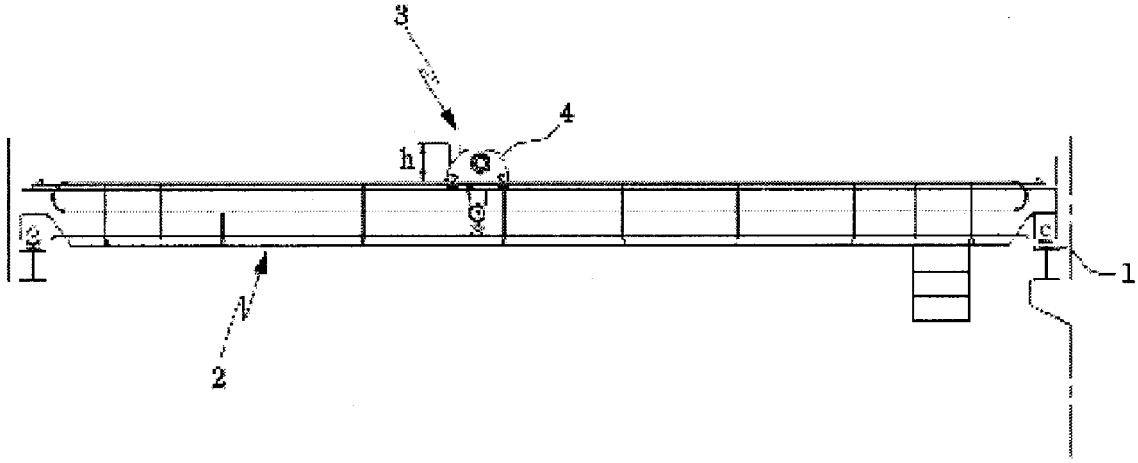
【Figure 2】 Prior Art
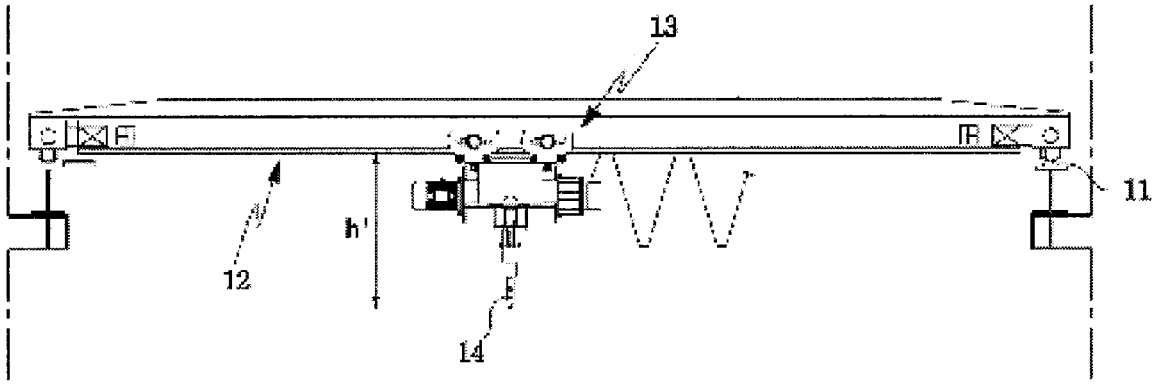

【Figure 3】 Prior Art
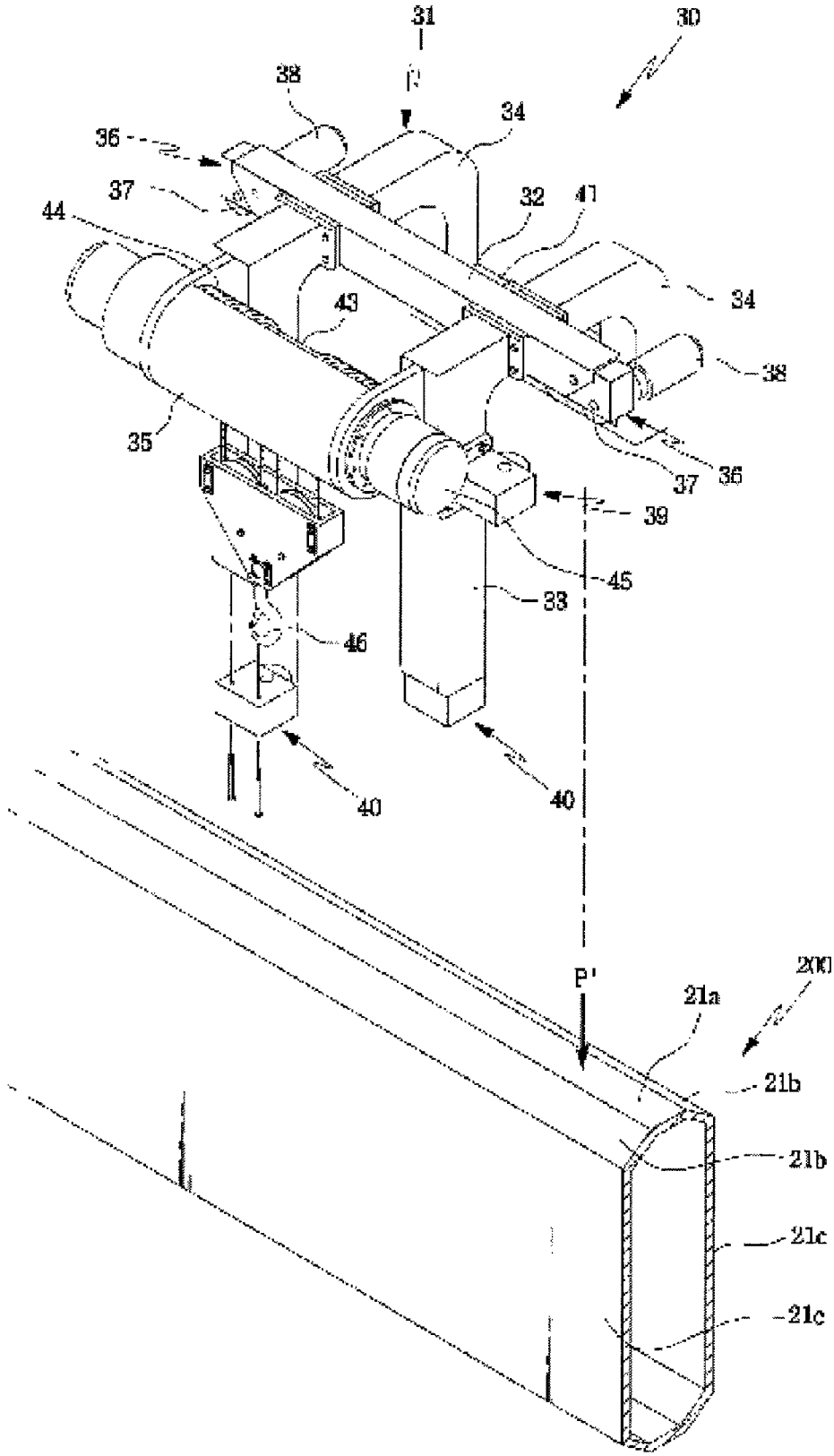

【Figure 4】 Prior Art
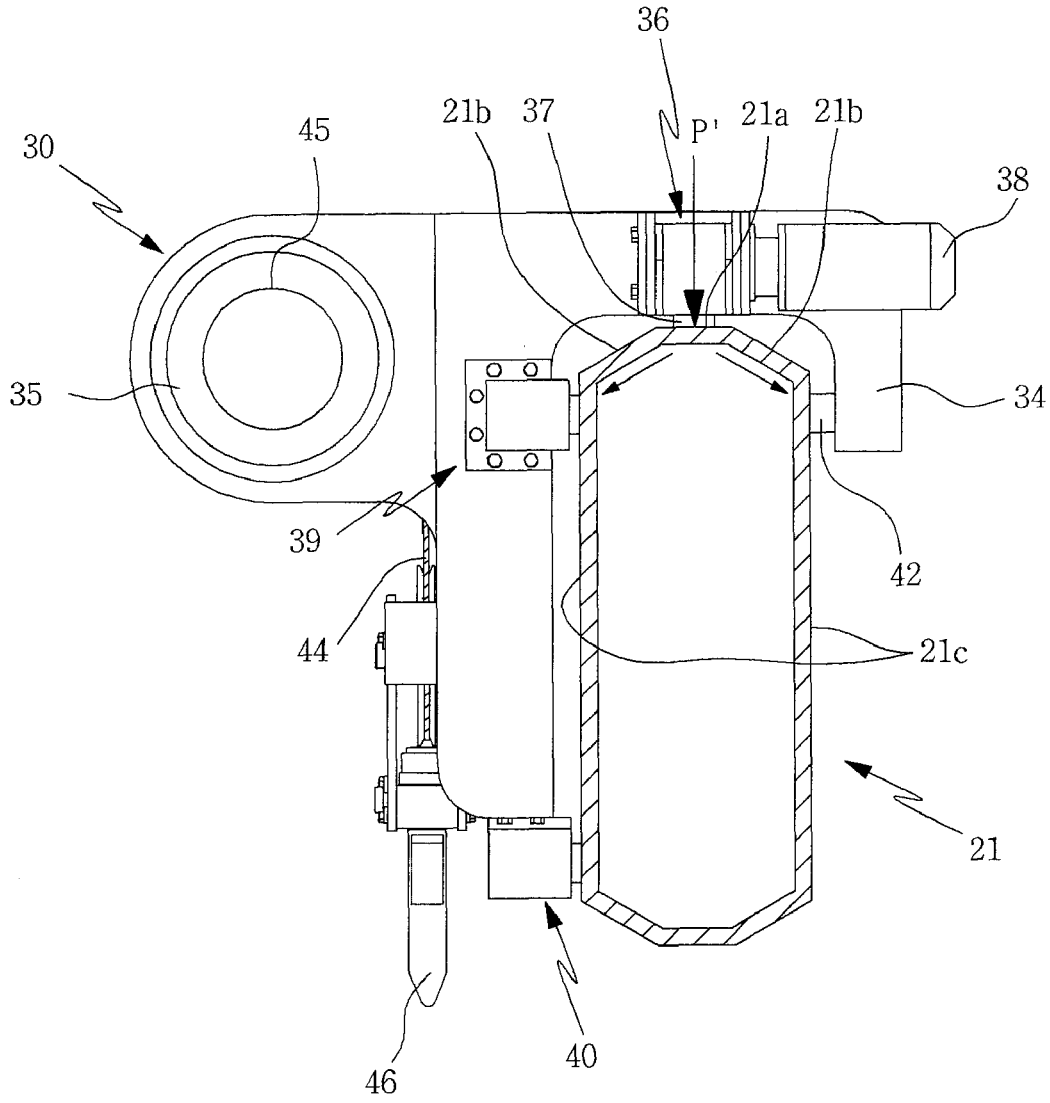

[Figure 5]
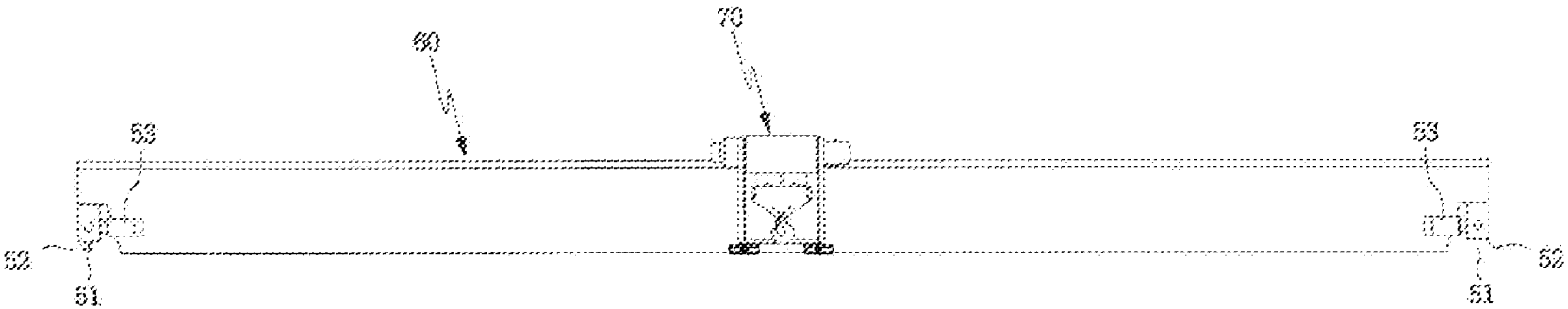

[Figure 6]
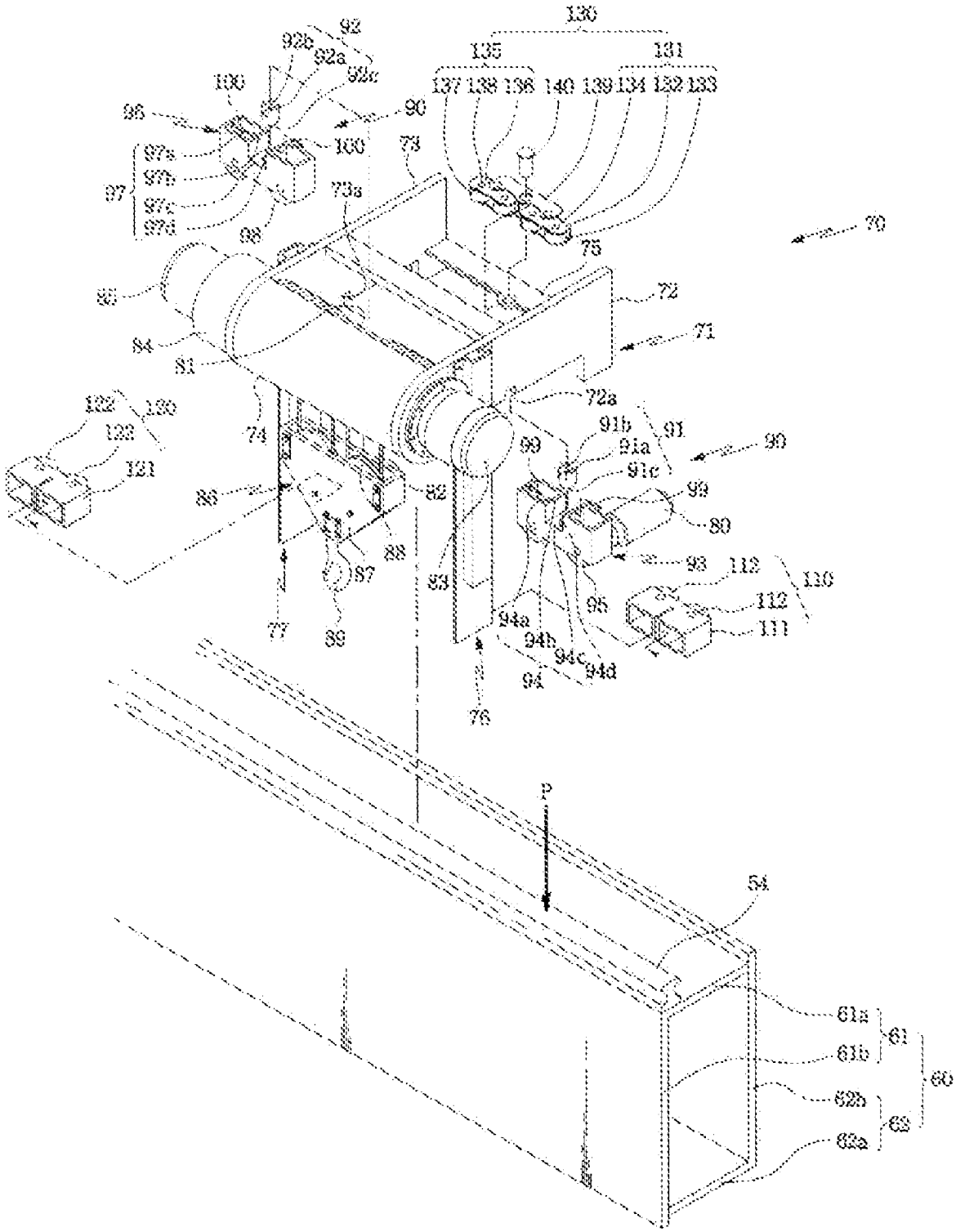

【Figure 7】
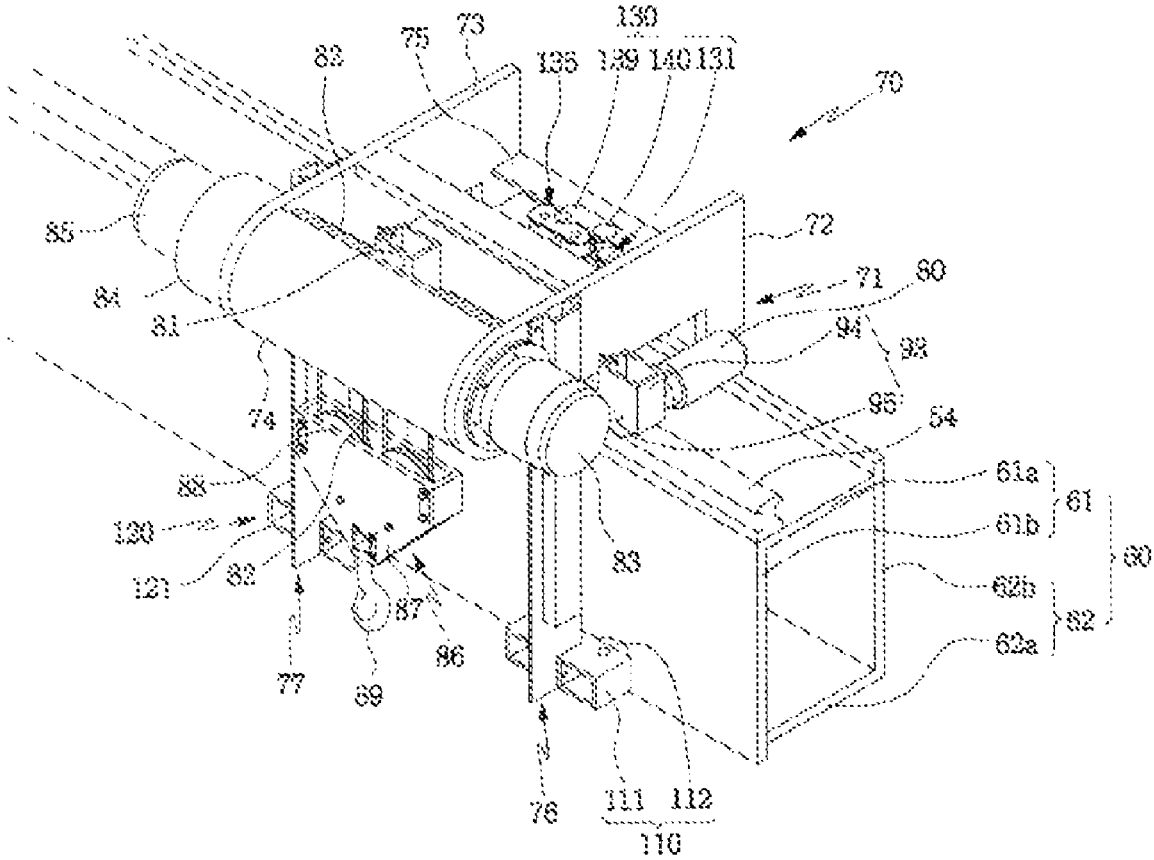
【Figure 8】
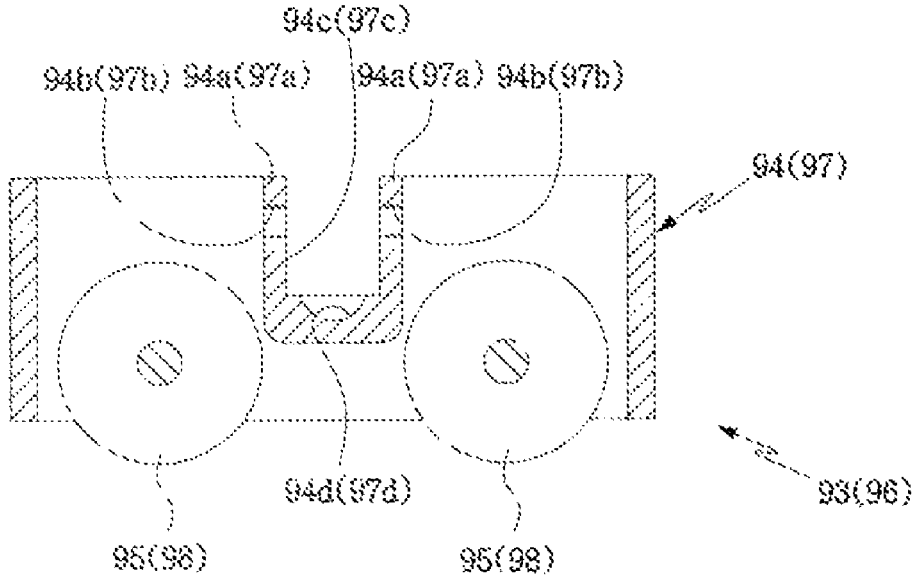

【Figure 9】
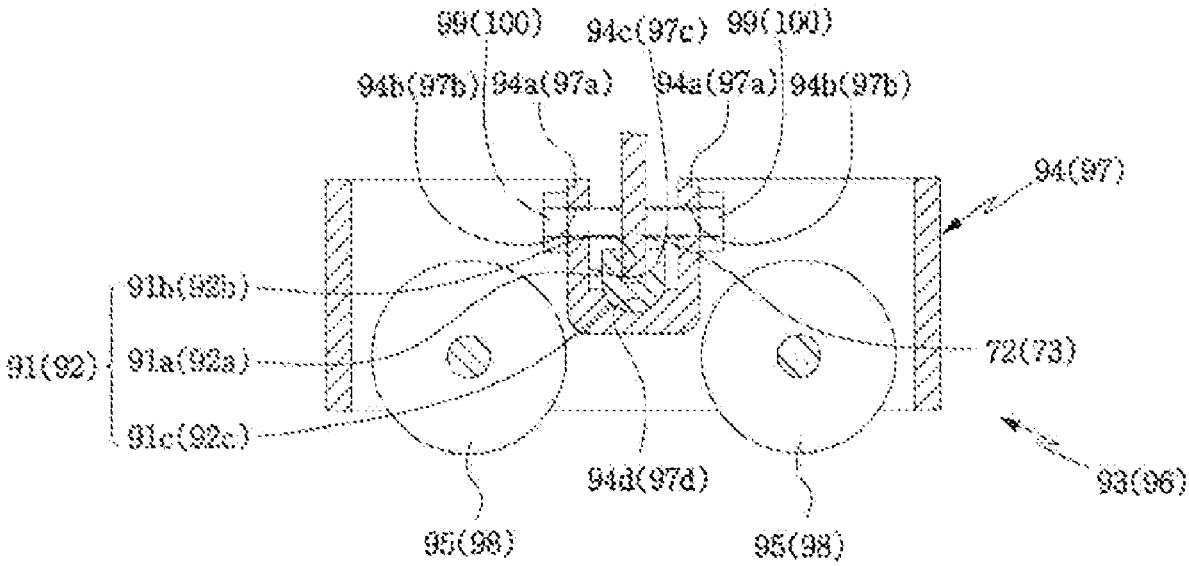
【Figure 10】
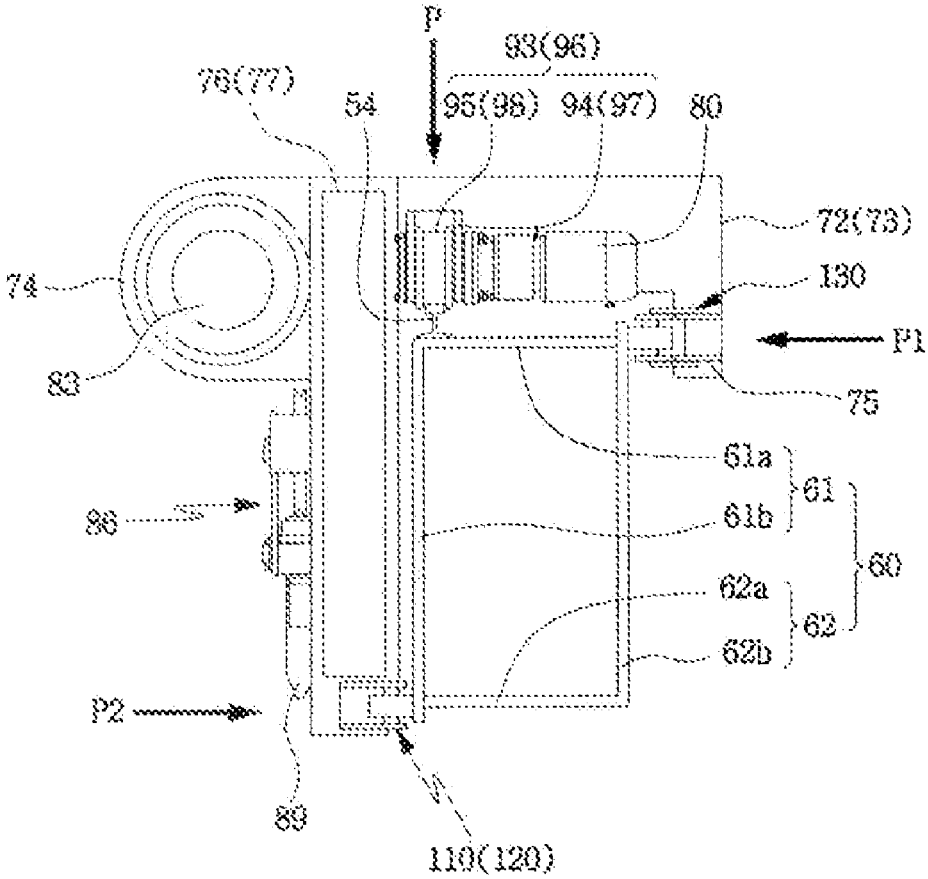

【Figure 11】
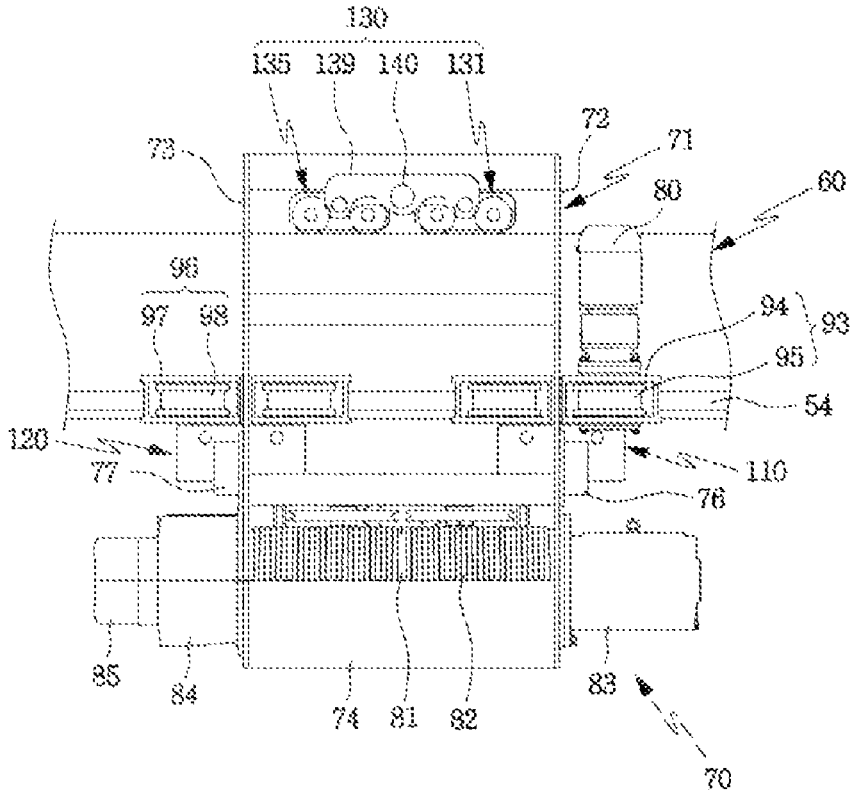
【Figure 12】
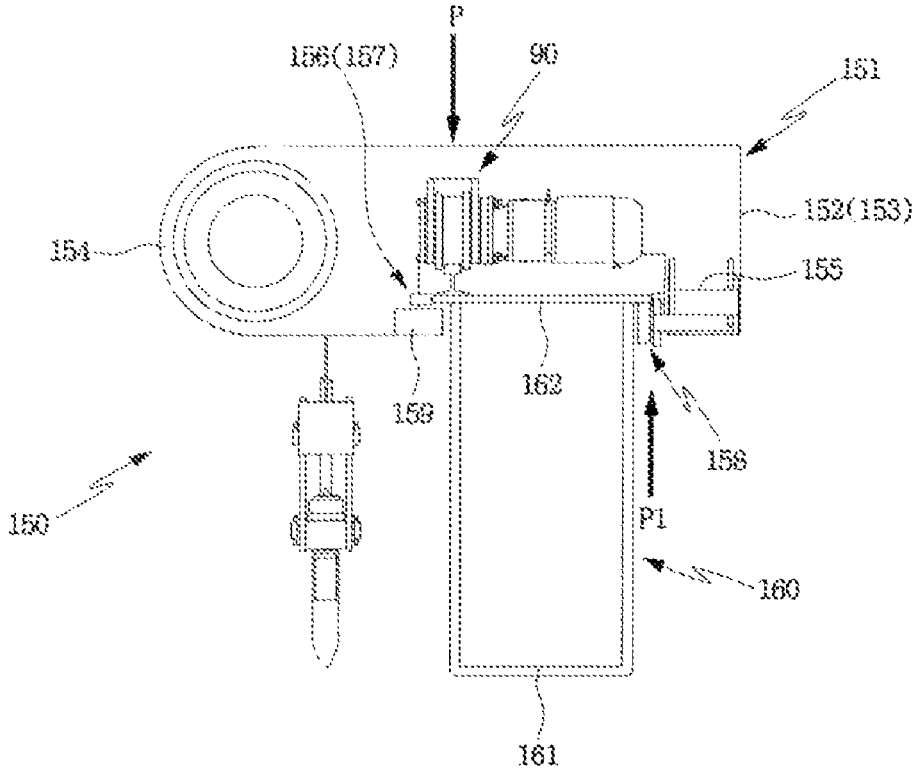

【Figure 13】
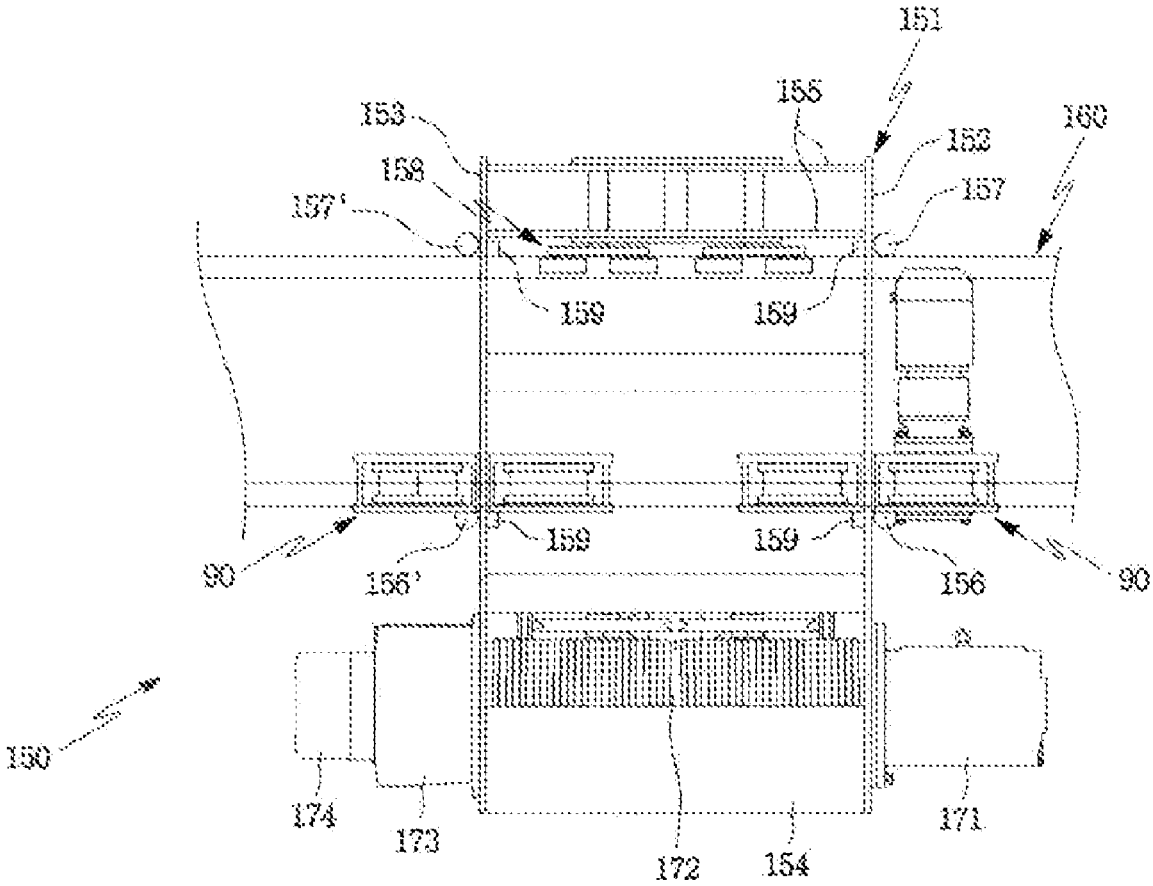

HOIST FOR LOW SPACE CRANE

TECHNICAL FIELD

The present invention relates to a hoist for a low space crane, and in particular to a hoist for a low space crane in which it is possible to prevent an impact load, which is transferred to a hoist frame in the course of shifting an object, from being transferred to a load support roller of a load support wheel part, and a biased load is balanced, and a hoist stably operates on a girder, so that the whole weight of a hoist decreases, whereby a hoisting capacity for an object can be increased.

BACKGROUND ART

As well known in the art, a crane is a machine or a machine apparatus which is designed to hoist an object using a driving force and moves in a horizontal direction and is designed to operate a winding and unwinding operation for lifting or lowering a hoisting object and a horizontal direction operation and a swing operation for horizontally moving the lifted object. So, the hoist works properly in a 3D space with the help of the above combined works, The crane consists of a pair of running rails, and a girder which is installed on the running rail and moves along the same, and a hoist which is installed on the girder and shifts along the same.

A running wheel is installed at both ends of the girder and is mounted on the running rail. A running motor is installed at the running wheel. When the running motor is driven, the running wheel rotates and allows the girder to move along the running rail.

The hoist installed at the girder comprises a hoist frame which supports the entire structure of the hoist, a cross running motor which is installed at the hoist frame and is mounted on the girder and shifts the hoist frame along the girder, a wire drum which is rotatably installed at the hoist frame and winds or unwinds a wire rope, a winding motor which is connected with the wire drum for driving the same, and a hook which is connected with a lower end of the wire rope and moves up or down as the wire rope is wound or unwound from the wire drum.

When a certain weight object is hung by the crane, the girder is moved along the X axis and Y axis by driving the running motor. The hoist installed on the girder is moved along the X axis and Y axis by driving the cross running motor, so that the weight object is positioned while matching with the coordinates X and Y of the hoist. The hook is lowered down by driving the winding motor of the hoist and is connected with the weight object, so that it is ready to move the weight object. So, finally it is possible to move the weight object in the reverse procedure of the above operation.

FIGS. 1 and 2 are schematic front views illustrating a conventional hoist for describing the problems encountered in the conventional art. FIGS. 3 and 4 are a schematic perspective view and a side cross sectional view another example of a conventional hoist for a low space crane. The problems of the conventional hoist will be described with reference to the above drawings.

FIGS. 1 and 2 are schematic front views illustrating a conventional hoist for describing the problems encountered in the conventional art. As shown therein, the hoist 3 of FIG. 1 is installed so that the hoist frame 4 is mounted on the upper side of the girder 2 of the running rail 1. Since part of the hoist 3 is exposed by the height h in the upper direction of the girder 2, a certain space at the upper side of the girder 2 is further needed. So, the installation height of the crane is lowered by the above space height.

The hoist 13 of FIG. 2 is installed at both ends of the girder 12 of the upper side of the running rail 11. So, almost parts of the hoist 13 are installed lower than the lower side of the girder 12. As compared to the hoist 3 of FIG. 1, since the conventional hoist 13 does not need the height h which is protruded from the upper side of the girder 12, it is possible to increase the entire height of the crane, but almost parts of the hoist 13 are installed below the lower side of the girder 12, so that the vertical transfer distance of the hook 14 decreases by the lowered height h'. So, the vertical transfer distance for hanging and lifting the weight object decreases.

So as to overcome the problems of FIGS. 1 and 2, the applicant of the present invention disclosed a Korean patent application number 10-2006-6576 filed on Jan. 21, 2006 (and published on Nov. 30, 2006 as Korean patent publication number KR-100654786) in which as shown in FIGS. 3 and 4, the installation height of the hoist 30 and the installation height of the girder 21 are overlapped, so that the total installation heights are minimized. The hoist 30 of FIGS. 3 and 4 is considered to be prior art for the purposes of the present application. The girder 21 has octagonal cross sections, and a horizontal contact surface 21*a* is formed at the upper center of the girder 21. A slant surface 21*b*, which is slanted downward, is formed at both sides of the contact surface 21*a*. A vertical surface 21*c* is formed at both sides of the slant surface 21*b*. According to the conventional girder 21, when a weight object is lifted, the weight of the lifting object is property supported by the contact surface 21*a*, namely, the upper center portion of the girder 21.

The hoist 30 mounted on the girder 21 contacts with the upper center of the girder 21, namely, the contact surface of the girder 21, so that the weight point P' properly works.

The low space crane hoist 30 includes a hoist frame 31 for supporting the entire structure with respect to the girder 21. The hoist frame 31 comprises a support frame 32 which is positioned at the center and supports the entire structure, a front frame 33 of which an upper end is fixed at both front sides of the support frame 32, and which is extended in a downward direction, a rear frame 34 of which an upper end is fixed at both rear sides of the support frame 32, and which is formed in a 90 degree angled shape, and a drum cover 35 which is fixed at the both front frames 33 and has a wire drum 43.

A plurality of elements are installed at the hoist frame 31 for lifting and moving a weight object. A lower support wheel part 36 mounted on the girder 21 is installed at both ends of the support frame 32, and a cross running motor 38 is connected with the load support wheel part 36 for thereby driving the load support roller 37 of the load support wheel part 36.

A pair of front upper support wheel parts 39 are installed at the upper side of the front frame 33 of the hoist frame 31 and are supported at the front upper side of the girder 21. A pair of front lower support wheel parts 40 are installed at the lower side of the front frame 33 and are supported at the front lower side of the girder 21. A rear support wheel part 42 is installed at the connection frame 41 connected with a pair of the rear frames 34 and is supported at the rear side of the girder 21.

A wire drum 43 is installed at the drum cover 35, and a winding motor 45 is connected with the wire drum 43. As the winding motor 45 operates, the wire drum 43 rotates for thereby winding or unwinding the wire rope 44, so that the hook 46 connected with the wire rope 44 moves up and down.

According to the conventional low space crane hoist 30, the load support wheel part 36, which supports the entire loads of the hoist 30 of the hoist frame 31 and the weight object, is installed at the support frame 32 of the center portion of the hoist frame 31. The girder 21 is designed to properly support the hoist 30.

The conventional low space crane hoist has the following problems.

First, since the weight of the weight object of the hoist 30 is concentrated at the upper center of the girder 21, the girder 21 may be buckled. According to the conventional hoist 30, the support frame 32, which supports the structure of the hoist frame 31, is positioned at the center of the hoist frame 31, and the load support wheel part 36 is installed at the support frame 32, and the load point P of the hoist frame 31 corresponds to the portion, where the support frame 32 and the load support wheel part 36 are positioned, namely, the center portion of the hoist frame 31. So, the load point P' is positioned at the center portion of the girder 21 which supports the load support wheel part 36 as the hoist frame 31 is mounted on the girder 21.

The hoist 30, which allows the load point P' is positioned at the center of the girder 21, causes the girder 21 to buckle owing to the following reasons.

The load point P' is applied to the contact surface 21*a* of the upper center of the girder 21 on which the low space crane hoist 30 is mounted, and two slant surfaces 21*b* support the same. The above two slant surfaces 21*b* are supported by means of the two vertical surfaces 21*c*. The load of the weight object is not directly transferred to the vertical surfaces 21*c* which support almost parts of the load, but is applied through the two slant surface 21 in slant directions. In a state that a plate is arranged in a vertical direction, when loads are applied to the plate at a slant angle, it bears a relatively larger load. However, when the load is applied in a slant direction, it may be buckled.

So, when a certain load of the weight load is applied to the contact surface 21*a* of the girder 21 of FIGS. 3 and 4, the load is transferred to the vertical surface 21*c* through the slant surface 21*b*, and the load applied to the two vertical surfaces 21*c* is not transferred in the vertical direction along the cross section center of the vertical surface 21*c*, but is transferred along the slant surface 21*b* at a slant angle, so that the buckling phenomenon of the girder 21 occurs a lot.

Second, when the weight object is hung by the hook 46 of the hoist 30 and is moved, the weight object may swing. The swing load is transferred to the hoist frame 31 via the wire rope 44, and the impact load transferred to the hoist frame 31 is directly transferred to the load support wheel part 36. The impact load transferred to the load support wheel part 36 causes the load support roller 37 to noncontinuously contact with the girder 21, so that the driving force transferred from the cross running motor 38 to the load support roller 37 is instantly prevented from being applied to the girder 21.

So, since the driving force transferred to the cross running motor 38, the load support roller 37 and the girder 21 is instantly disconnected, the driving efficiency of the hoist 30 decreases, so that the nonuniform transfer speed occurs.

Third, each element belonging to the hoist frame 31, namely, the support frame 32, a pair of the front frames 33 and a pair of the rear frames 34 are formed in a cubic pipe shape or a hollow rectangular pipe shape. So, the entire size and weight of the hoist frame 31 increases owing to a relatively larger size of each element belonging to the hoist frame 31. The hoisting capacity decreases by the increased weight of the hoist.

Fourth, two front upper support wheel parts 39 are installed at a pair of the front frames 33 for stably supporting the hoist frame 31 on the girder 21, and two front lower support wheel parts 40 are installed at the lower side of the front frame 33, and two rear support wheel parts 42 are installed at a pair of the rear frames 34, so that six support wheel parts are totally needed.

So, since six support wheel parts are needed and installed, the productivity of the hoist 30 decreases. As the number of support wheel parts increases, the hoist frame 31 and the girder 21 can be more stably supported. However, in this case, since the impact load transferred to the hoist frame 31 is directly transferred to the support wheel part, the life of each support wheel part is shortened.

DISCLOSURE OF INVENTION

Technical Problem

Accordingly, it is an object of the present invention to provide a hoist for a low space crane which is able to prevent an impact load from being transferred from the hoist frame to the load support wheel part.

It is another object of the present invention to provide a hoist for a low space crane in which a load weight support wheel part can stably run along a guide rail.

It is further another object of the present invention to provide a hoist for a low space crane which is able to decrease the entire loads of a hoist frame.

In the present invention, when av object having a large weight is moved, a girder is not buckled so that a first load support wheel part and a second load support wheel part are positioned on a first vertical surface of a girder. Even when an impact load is supplied to the hoist frame as the object swing, it is properly absorbed and offset by an equal distribution member. Since the entire vertical weight is properly distributed, a driving efficiency of the hoist is enhanced, and the hoist is not derailed from the guide rail. Since the entire size and weight of the hoist frame largely decrease, the hoisting capacity can be enhanced by the decreased weight of the same. Since the hoist is supported on the girder at three points of the first front support wheel part, the second front support wheel part and the rear support wheel part, the girder and the hoist mounted on the same can be most stably supported by a minimum number of support wheel parts.

Technical Solution

To achieve the above objects, in a hoist for a low space crane which is mounted on a guide rail installed at a girder and moves along the guide rail for thereby transferring a certain weight object, there is provided a hoist for a low space crane which comprises hoist frames which are arranged so that a load point P transferred to the girders is positioned at a vertical surface of one side of each girder, and the balance of biased load is maintained, for thereby decreasing the entire load; and an equal distribution means which is installed between the hoist frames and absorbs the impact load transferred to the hoist frames and equally distributes the entire vertical weight load.

The hoist frame comprises first and second plate shaped support plates which are provided at both sides of the same and form a structure of the hoist frame and are connected with the equal distribution means, respectively; a drum cover which is connected with a corresponding end of each of the first and second plates and covers the surrounding portions of the wire drum; a connection plate which is connected with a corresponding other end of each of the first and second support plates and is provided with a rear support wheel part for supporting the rear side of the girder; and first and second reinforcing brackets which are fixed at both ends of the first and second support plates, and of which a lower end of each bracket is opposite to the front lower side of the girder, and first and second front support wheel parts supported by the front side of the girder are installed at the lower side of the same.

The equal distribution means comprises first and second support pins and which are fixed at the lower sides of the first and second support plates; and first and second load support wheel parts which are mounted on the guide rail and are moves along the same, with the lower sides of the first and second support pins being mounted thereon and being roll-contact with the same.

The first and second support pins comprise first and second support parts having first and second slots which are inserted into the lower sides of the first and second support plates, respectively, and first and second spherical contact parts which are formed at the lower sides of the first and second support parts.

The first and second load support wheel parts comprise first and second bodies which have first and second insertion grooves at the center portions of the same for mounting the first and second support plates thereon, and first and second spherical grooves formed so that the first and second contact parts of the first and second support pins roll-contact with the lower sides of the first and second insertion grooves; and first and second load support rollers which are engaged with the first and second bodies and are mounted on the guide rail and run along the same.

There are further provided first and second support bolts which are engaged with the first and second bodies, and of which the ends are supported by the first and second support plates, so that a certain interval is maintained between the first and second insertion grooves, and between the first and second support plates.

The rear support wheel part is supported by a rear upper side of the girder, and the first and second front support wheel parts are supported by the front lower side of the girder, so that the hoist is supported by three points of the girder.

The hoist frame comprises first and second plate shaped support plates which are provided at both sides of the same and form a structure of the hoist frame and have first and second front guide wheels; a drum cover which is connected with a corresponding end of each of the first and second support plates and covers the surrounding portions of the wire drum; and a connection plate which is connected with a corresponding other end of each of the first and second support plates and has a rear support wheel part supported by a rear side of the girder.

Advantageous Effects

In the present invention, a buckling phenomenon does not occur at the girder even when a relatively heavy object is transferred by providing the first and second support wheel parts on the first vertical surface of the girder, and even when an impact load is transferred to the hoist frame owing to a swing operation of the weight object, the equal distribution unit properly absorbs the impact load and offsets the same for thereby equally distributing the entire vertical load, so that the driving efficiency of the hoist is significantly enhanced, and the hoist is prevented from being escaped from the guide rail. In addition, since the entire sizes and weight of the hoist frame are significantly decreased, it is possible to enhance the hoisting weight as weight as the decreased weight of the hoist. Since the hoist is supported by three points with the helps of the first and second front support wheel parts, and the rear support wheel part, the girder and the hoist mounted thereon can be most stably supported using at least number of the support wheel parts.

BRIEF DESCRIPTION OF THE DRAWINGS

FIGS. 1 and 2 are schematic front views illustrating a conventional hoist for describing the problems encountered in the conventional art.

FIGS. 3 and 4 are a schematic perspective view and a side cross sectional view another example of a conventional hoist for a low space crane.

FIG. 5 is a schematic front view illustrating a state that a hoist is installed at a girder for a low space crane according to the present invention.

FIG. 6 is a partial disassembled perspective view illustrating a hoist for a low space crane according to the present invention.

FIG. 7 is a perspective view of an engagement of FIG. 6.

FIGS. 8 and 9 are a partial cross sectional view and a cross sectional view of an engaged state of the important elements of the present invention.

FIGS. 10 and 11 are a schematic side cross sectional view and a plane view illustrating a state that a hoist for a low space crane is installed according to the present invention.

FIGS. 12 and 13 are a partial side cross sectional view and a plane view illustrating a hoist for a low space crane according to another embodiment of the present invention.

| * Descriptions of reference numerals in the drawings * | |
|---|---|
| 51: | running rail |
| 52: | running wheel |
| 53: | running motor |
| 54: | guide rail |
| 60, 160: | girder |
| 61: | first girder |
| 61a: | first horizontal surface (of first girder) |
| 61b: | first vertical surface (of first girder0 |
| 62: | second girder |
| 62a: | second horizontal surface (of second girder) |
| *6262b: | second vertical surface (of second girder) |
| 70, 150: | hoist |
| 71, 151: | hoist frame |
| 72, 152: | first support plate |
| 72a: | first engaging groove (of first support plate) |
| 73, 153: | second support plate |
| 73a: | second engaging groove (of second support plate) |
| 74, 154: | drum cover |
| 75, 155: | connection plate |
| 76: | first reinforcing bracket |
| 77: | second reinforcing bracket |
| 80: | cross running motor |
| 81: | wire drum |
| 82: | wire rope |
| 83: | winding motor |
| 84: | decelerator |
| 85: | brake |
| 86: | hook part |
| 87: | sheeve cover |
| 88: | sheeve |
| 89: | hook |
| 90: | equal distribution unit |
| 91: | first support pin |
| 91a: | first support part (of first support pin) |
| 91b: | first slot (of first support pin) |
| 91c: | first contact part (of first support pin) |
| 92: | second support pin |
| 92a: | second support part (of second support pin) |
| 92b: | second slot (of second support pin) |
| 92c: | second contact part (of second support pin) |
| 93: | first load support wheel part |
| 94: | first body |

-continued

| * Descriptions of reference numerals in the drawings * | |
|---|---|
| 94a: | first side wall (of first body) |
| 94b: | first engaging hole (of first body) |
| 94c: | first insertion groove (of first body) |
| 94d: | first spherical groove (of first body) |
| 95: | first load support roller |
| 96: | second load support wheel part |
| 97: | second body |
| 97a: | second side wall (of second body) |
| 97b: | second engaging hole (of second body) |
| 97c: | second insertion groove (of second body) |
| 97d: | second spherical groove (of second body) |
| 98: | second load support roller |
| 99: | first support bolt |
| 100: | second support bolt |
| 110: | first front support wheel part |
| 111: | first roller cover |
| 112: | first front support roller |
| 120: | second front support wheel part |
| 121: | second roller cover |
| 122: | second front support roller |
| 130, 158: | rear support wheel part |
| 131: | first rear support wheel part |
| 132: | first piece |
| 133: | first rear roller |
| 134: | first hinge pin |
| 135: | second rear support wheel part |
| 136: | second piece |
| 137: | second rear roller |
| 138: | second hinge pin |
| 139: | engaging plate |
| 140: | hinge shaft |
| 156, 156': | first front guide wheel |
| 157, 157': | second front guide wheel |
| 159: | protector |
| P: | load point |

BEST MODE FOR CARRYING OUT THE INVENTION

In a hoist for a low space crane which is mounted on a guide rail installed at a girder and moves along the guide rail for thereby transferring a certain weight object, there is provided a hoist for a low space crane which comprises hoist frames 71 and 151 which are arranged so that a load point P transferred to the girders 60 and 160 is positioned at a vertical surface of one side of each girder 60, 160, and the balance of biased load is maintained, for thereby decreasing the entire load; and first and second equal distribution units 90 installed between the hoist frames 71 and 151 and absorbing the impact load transferred to the hoist frames 71 and 151 and equally distributing the entire vertical weight load.

Mode for the Invention

The detailed features and advantages of the present invention will be described in detail with reference to the accompanying drawings.

FIG. 5 is a schematic front view illustrating a state that a hoist is installed at a girder for a low space crane according to the present invention. FIG. 6 is a partial disassembled perspective view illustrating a hoist for a low space crane according to the present invention. FIG. 7 is a perspective view of an engagement of FIG. 6. FIGS. 8 and 9 are a partial cross sectional view and a cross sectional view of an engaged state of the important elements of the present invention. FIGS. 10 and 11 are a schematic side cross sectional view and a plane view illustrating a state that a hoist for a low space crane is installed according to the present invention. The crane having a low space crane hoist 70 according to the present invention comprises a pair of running rails 51, a girder 60 which is installed on the running rail 51 and moves along with the same, and a hoist 70 which is installed at the girder 60 and moves along with the same.

A running wheel 52 is installed at both ends of the girder 60 and is mounted on the running rail 51. A running motor 53 is installed at the running wheel 52. When the running motor 53 is driven, the running wheel 52 rotates, and the girder 60 is transferred along the running rail 51.

In the girder 60, the load point P working by the hoist 70 operates at one vertical surface among the vertical surfaces of the girder 60. It is preferred that the cross section of the girder 60 has a hollow rectangular shape for satisfying the above condition.

The construction of the girder 60 will be described in more detail. The girder 60 consists of a first girder 61 and a second girder 62, and the first and second girders 61 and 62 have 90 degree angled cross sections, and the first girder 61 consists of a first horizontal surface 61*a* and a first vertical surface 61*b*, and the second girder 62 consists of a second horizontal surface 62*a* and a second vertical surface 62*b*.

The first and second girders 61 and 62 are fixed with each other for thereby forming a hollow cubic shape which becomes a girder 60 for supporting the hoist 70 according to the present invention. The ends of the first girder 61 and the second girder 62 are contacted with each other and are temporarily assembled so that they form rectangular cross sections. The contacted ends are fixed with each other for thereby forming a girder 60. Here, the fixing method is a welding method.

According to the girder 60, the first horizontal surface 61*a* of the first girder 61 form an upper surface of the girder 60, and the first vertical surface 61*b* of the first girder 61 forms a front vertical surface of the girder 60, and the second horizontal surface 62*a* of the second girder 62 forms a lower surface of the girder 60, and the second vertical surface 62*b* of the second girder 62 forms a rear vertical surface of the girder 60.

A guide rail 54 is installed on the first vertical surface 61*b* of the first girder 61 in the girder 60 in its longitudinal direction. The first load support wheel part 93 and the second load support wheel part 96 of the hoist 70 are mounted on the guide rail 54 for thereby forming a load point P of an object which is to be hoisted.

Here, since the girder 60 has a rectangular cross section as compared to the girder 21 of FIGS. 2A and 2B having an octagonal cross section, so that the process is decreased in half. Since the process is significantly reduced in the present invention, the productivity of the girder 60 is enhanced.

According to the girder 60, the load point P is applied to the first vertical surface 61*b* among the four surfaces of the girder 60 based on the hoist 70.

The load point P applied to the girder 60 when hoisting an object is vertically transferred to the entire surfaces of the first vertical surface 61*b* of the first girder 61. The load point P is not applied at only part of the cross section area among the entire cross section area of the first vertical surface 61*b*, but is applied to the entire cross section areas of the first vertical surface 61*b*, so that the cross section area for supporting the load point P is maximized. So, even when a relatively heavier object is hoisted, the buckling phenomenon does not occur at the girder 60.

As shown in FIGS. 6 and 7, the hoist 70 is installed at the girder 60 comprises a hoist frame 71 formed so that the load point P is positioned at the vertical surface of the girder 60, and the balance of the biased load is maintained for thereby decreasing the total weight, and first and second equal distribution units 90 installed between the hoist frame 71 and the guide rail 54 for thereby absorbing the impact transferred to the hoist frame 71 and equally distributing the entire vertical load.

The hoist frame 71 comprises first and second support plates 72 and 73 which are provided at both sides and form a structure of the hoist frame 71 and have first and second engaging grooves 72*a* and 73*a* formed at the lower side, a drum cover 74 which is connected with each end of the first and second support plates 72 and 73 and covers the surrounding portions of the wire drum 81, a connection plate 75 which is connected with each other end of the first and second support plates 72 and 73 and has a rear support wheel part 130 which is supported at the rear side of the girder 60, and first and second reinforcing brackets 76 and 77 which are fixed at both sides of the first and second support plates 72 and 73 and have first and second front support wheel parts 110 and 120 supported at the front side of the girder 60, with the lower ends of the same being opposite to the front lower side of the girder 60.

The hoist frame 71 is formed as the winding motor 83, the wire drum 81, the decelerator 84, and the brake 85 are integral with the first and second support plates 72 and 73. The first front support wheel part 110, the second front support wheel part 120 and the rear support wheel part 130 may be further provided at the integral hoist frame 71.

The hoist frame 71 is formed in a small, light and simple structure as the first and second support plates 72 and 73 are formed in a plate shape, so that the entire size and weight can be significantly decreased. The total hoisting weight including the hoist 70 may be enough, so that the hoisting capacity may be increased by the decreased weight of the hoist 70.

A wire drum 81 on which the wire rope 82 is wound is installed at an inner side of the drum cover 74 of the hoist frame 71. A winding motor 83 is installed at the wire drum 81 for winding or unwinding the wire rope 82 from the wire drum 81. A decelerator 84 is connected with the winding motor 83 for decelerating the rotation speed. The brake 85 is connected for driving the winding motor 83.

A hook part 86 is provided at a lower end of the wire rope 82 for hanging a hoisting object. The hook part 86 consists of a sheeve 88 connected with the wire rope 82, a sheeve cover 87 in which the sheeve 88 is installed, and a nook 89 connected with the sheeve cover 87. Each equal distribution unit 90, which is a key element of the present invention along with the hoist frame 71, comprises a support pin 91 or 92 fixed at the lower sides of the first or second support plates 72 and 73, and first or second load support wheel parts 93 and 96 which are mounted on the guide rail 54 and roll-contact thereon as the first and second support pins 91 and 92 are mounted.

Here, the first and second support pins 91 and 92 comprise first and second support parts 91*a* and 92*a* having first and second slots 91*b* and 92*b* inserted into the lower sides of the first and second support plates 72 and 73, and spherical first and second contact parts 91*c* and 92*c* formed at the lower sides of the first and second support parts 91*a* and 92*a*.

As shown in FIGS. 6, 8 and 9, the first and second load support wheel parts 93 and 96 comprise first and second insertion grooves 94*c* and 97*c* so that the first and second support plates 72 and 73 are located at the center, first and second bodies 94 and 97 having first and second spherical grooves 94*d* and 97*d* so that the first and second contact parts 91*c* and 92*c* of the first and second support pins 91 and 92 roll-contact with the lower sides of the first and second insertion grooves 94*c* and 97*c*, and first and second load support rollers 95 and 98 which are engaged at the first and second bodies 94 and 97 and are mounted on the guide rail 54 and run along the same.

First and second side walls 94*a* and 97*a* are formed at the first and second insertion grooves 94*c* and 97*c* of the first and second bodies 94 and 97. First and second engaging holes 94*b* and 97*b* are formed at the first and second side walls 94*a* and 97*a*. The first and second support bolts 99 and 100 are engaged with the first and second engaging holes 94*b* and 97*b*.

Here, the first and second support bolts 99 and 100 are engaged with the first and second engaging holes 94*b* and 97*b* of the first and second side walls 94*a* and 97*a*. The ends of the same are supported by the first and second support plates 72 and 73, so that constant intervals are maintained between the first and second insertion grooves 94*c* and 97*c* and the first and second support plates 72 and 73.

The cross running motor 80 is connected with the first load support roller 95 of the first load support wheel part 93. As the cross running motor 80 is driven, the hoist 70 moves along the guide rail 54. The cross running motor 80 may be installed at the first load support wheel part 93, and may be installed at the second load support wheel part 96. It may be installed at both the first and second load support wheel parts 93 and 96.

When the load of the weight object is applied to the first and second load support wheel parts 93 and 96, the load is applied to the girder 60 via the guide rail 54. Here, the guide rail 54 is not installed at the center of the upper surface of the girder 60, but is installed at one side vertical surface of the girder 60, namely, on the first vertical surface 61*b* of the first girder 61. So, when the load of the weight object is transferred to the guide rail 54, the load is vertically transferred to the first vertical surface 61*b* of the first girder 61, so that the load point P of the weight object is focus-transferred at the entire cross section area of the first vertical surface 61*b*.

Since the load point P of the weight object is directly focus-applied to the first vertical surface 61*b*, the cross sectional area for supporting the load point P is maximized, so that it is possible to substantially support large load. So, it is possible to substantially support large load as compared to the conventional art in which the load point P' is applied to the center of the horizontal surface of the girder 21, so that it is possible to prevent buckling of the girder 60.

The first and second equal distribution units 90, which each consist of the first or second load support wheel parts 93 and 96 and the first or second support pins 91 and 92, can well absorb and offset the impact loads transferred to the hoist frame 71 as the weight object swings. So, the entire vertical loads can be equally distributed. The transfer operations of the impact load will be described in detail.

The swing load of the weight object is transferred to the wire rope 82 via the hook 89, and the swing load is transferred to the first and second support plates 72 and 73 via the wire drum 81, and the impact load is applied to the first and second support pins 91 and 92. When the impact load owing to the weight object is transferred to the first and second support pins 91 and 92, the first and second support pins 91 and 92 start swinging owing to the impact load, so that the rolling contact occurs between the first and second contact parts 91*c* and 92*c* of the first and second support pins 91 and 92 and the first and second spherical grooves 94*d* and 97*d* of the first and second load support wheel parts 93 and 96 for thereby absorbing the impact load.

So, the impact load transferred to the hoist frame 71 is prevented from being transferred to the first and second load support rollers 95 and 98 of the first and second load support wheel parts 93 and 96, so that the driving efficiency of the hoist 70 is enhanced, and the hoist 70 is prevented from being escaped from the guide rail 54.

The first and second front support wheel parts 110 and 120 supported at the front side of the girder 60 consist of the first and second roller covers 111 and 121 fixed at the first and second reinforcing brackets 76 and 77, and the first and second front support rollers 112 and 122 installed at the first and second roller covers 111 and 121 and supported by the front side of the girder 60.

The rear support wheel part 130 supported by the rear side of the girder 60 consists of the first and second rear support wheel parts 131 and 135, the engaging plate 139 hinged with the first and second rear support wheel parts 131 and 135 at both sides of the same, and a hinge shaft 140 engaged with the engaging plate 139 and the connection plate 75. Here, the first rear support wheel part 131 consists of a pair of first rear rollers 133 supported by the rear side of the girder 60, and a first piece 132 which is engaged with the first rear rollers 133 with the first hinge pin 134. Here, the second rear support wheel part 135 consists of a pair of second rear rollers 137 supported by the rear side of the girder 60, and a second piece 136 in which the second rear rollers 137 are engaged with the second hinge pin 138.

Here, the rear support wheel part 130 is supported by three points along with the first and second front support wheel parts 110 and 120 at the front lower side of the girder 60. Since the hoist 70 mounted on the girder 60 is supported by three points with the helps of the first and second front support wheel parts 110 and 120 supporting two portions of the front lower side of the girder 60 and the rear support wheel part 130 which supports one point of the rear upper side of the girder 60, it is possible to most stably support the girder 60 and the hoist 70 with at least support wheel part.

As shown in FIG. 10, the rear support wheel part 130 is supported by the rear upper side of the girder 60, namely, the upper side of the second vertical surface 62*b* of the second girder 62 and is positioned on the same horizontal line as the first horizontal surface 61*a* of the first girder 61. The first and second front support wheel parts 110 and 120 installed at the first and second reinforcing brackets 76 and 77 are supported by the lower side of the first vertical surface 61*b* of the first girder 61 and is positioned on the same horizontal line as the second horizontal surface 62*a* of the second girder 62.

When the hoist 70 is fully slanted forward by the weight object hung at the hook 89, the hoist 70 is prevented from being escaped from the girder 60 with the helps of the rear support wheel part 130, the first front support wheel part 110 and the second front support wheel part 120.

When the entire structure of the hoist 70 is slanted forward, namely, when the rear side of the hoist 70 is lifted up, the first load point P1 is applied to the rear support wheel part 130 in the direction of the first horizontal surface 61*a* of the first girder 61, and the second load point P2 is applied to the first and second front support wheel parts 110 and 120 in the direction of the second horizontal surface 62*a* of the second girder 62.

So, since the first and second load points P1 and P2 are focus-applied to the entire cross section areas of the first and second horizontal surfaces 61*a* and 62*a*, the horizontal cross section areas for directly supporting the first and second load points P1 and P2 are maximized, and even when a relatively larger pressure is applied to the first and second load points P1 and P2, the girder 60 can substantially support the same.

According to the present invention, the hoist 70 is designed so that the load of the weight object is applied to one vertical surface between two surfaces of the girder 60, so that the entire size and weight of the hoist can decrease. The following advantages are obtained.

First, the first and second load support wheel parts 93 and 96 of the hoist 70 are mounted on the first vertical surface 61*b* of the girder 60. So, the load of the weight object is concentrated on the entire cross section area of the first vertical surface 61*b* via the first and second load support wheel parts 93 and 96. So, since the load point P is directly applied to the entire cross section areas of the first vertical surface 61*b* as compared to when the load point P is concentrated on part of the cross section area among the entire surfaces of the first vertical surface 61*b*, the cross section areas for supporting the load point P is maximized, so that the buckling problem of the girder 60 does not occur.

Second, even when impact load is applied to the hoist frame 71 owing to the swing of the weight object, the equal distribution units 90 absorb and offset the same. When the impact load transferred to the first and second support plates 72 and 73 via the weight object, the hook 89, the wire rope 82 and the wire drum 81 is transferred to the first and second support pins 91 and 92, the first and second support pins 91 and 92 swing owing to the impact load, so that the rolling contact occurs between the first and second contact parts 91*c* and 92*c* of the first and second support pins 91 and 92 and the first and second spherical grooves 94*d* and 97*d* of the first and second load support wheel parts 93 and 96 for thereby absorbing impact loads. So, since the impact load transferred to the hoist frame 71 is prevented from being transferred to the first and second load support rollers 95 and 98 of the first and second load support wheel parts 93 and 96, the driving efficiency of the hoist 70 is enhanced, and the hoist 70 is prevented from being escaped from the guide rail 54.

Third, since the first and second support plates 72 and 73, which are important elements of the hoist frame 71, are formed in plate shapes, they are light and small sized. So, the entire size and weight of the hoist frame 71 is significantly decreased, so that the total hoisting capacity including the hoist 70 increases, whereby it is possible to hoist the weight as weight as the decreased weight of the hoist 70.

Fourth, since the hoist frame 71 mounted on the girder 60 are supported by three points by means of the first front support wheel part 110 and the second front support wheel part 120 which support two points of the front lower side of the girder 60 and the rear support wheel part 130 which supports one point of the rear upper side of the girder 60, the girder 60 and the hoist 70 mounted thereon can be most stably supported using at least number of support wheel parts.

FIGS. 12 and 13 are a partial side cross sectional view and a plane view illustrating a hoist for a low space crane according to another embodiment of the present invention. The above hoist 150 is characterized in that it is provided with the hoist frame 151.

The hoist frame 151 comprises first and second support plates 152 and 153 which are provided at both sides of the same and form a structure of the hoist frame 151 and have first and second front guide wheels 156' and 156' and 157 and 157', a drum cover 154 which is connected with one end of each first and second support plate 152, 153 and surrounds the surrounding portions of the wire drum, and a connection plate 155 which is connected with the other end of each first and second support plate 152, 153 and includes a rear support wheel part 158 which is supported by the rear side of the girder 160 having the first and second girders 161 and 162.

As described with the helps of FIGS. 5 through 11, first and second equal distribution units 90 are provided between the hoist frame 151 and the guide rail for absorbing an impact load transferred to the hoist frame 151 and uniformly distributing the entire vertical weight load. Since the construction and operation thereof are same as the earlier described construction, the descriptions of the same will be omitted. In the hoist frame 151, since the winding motor 171, the wire drum 172, the decelerator 173 and the brake 174 are integrally formed at the first and second support plates 152 and 153, the first and second front guide wheels 156 and 156' and 157 and 157' and the rear support wheel part 158 are installed at the integral type hoist frame 151 when they are necessary.

Since the rear support wheel part 158 is the same as the rear support wheel part 130 of FIGS. 5 through 11, the detailed description of the same will be omitted. The rear support wheel part 158 contacts with the rear side of the second girder 162 when the first load point P1 is applied to the rear side of the girder 160, and supports the same. When the entire structure of the hoist 150 is slanted forward when the hoist 150 hoists the weight object, the first load point P1 is applied to the rear side of the girder 160, and the rear support wheel part 158 contacts with the lower surface of the rear end of the second girder 162 and supports the same.

The hoist frame 151 is the same as the hoist frame 71 of FIGS. 5 through 11 except the first and second reinforcing brackets 76 and 77. So, the first and second front guide wheels 156 and 156' and 157 and 157' are directly installed at the first and second support plates 152 and 153. So, the hoist 150 having the above hoist frame 151 guides when the hoist 150 moves along the girder 160 as the first and second front guide wheels 156 and 156' and 157 and 157' are positioned at two front positions and two rear positions of the girder 160, and the rear support wheel part 158 is supported by the upper side of the girder 160. In the hoist 150 of the present invention, since the first and second front guide wheels 156 and 156' and 157 and 157' and the rear support wheel part 158 are all supported by the upper side of the girder 160, a light weight object can be also easily hoisted.

As shown in FIG. 12, the low space crane hoist according to the present invention may further comprise a falling down prevention protector 159 at the first and second support plates 152 and 153 at the lower sides of the first and second front guide wheels 156 and 156' and 157 and 157'. The falling down protector 159 is installed at the front upper sides of the girder 160 by two units, and is further installed at rear upper sides of the same by two units, so that four units are totally installed. FIG. 12 shows a state that the falling down protector 159 is installed at only the hoist 150 of the front side of the girder 160. As shown in FIG. 13, the falling down protector 159 may be installed at the front and rear lower sides of the second girder 162 by two units being opposite to each other.

The falling down protector 159 further supports the first and second front guide wheels 156 and 156' and 157 and 157'. When the first and second front guide wheels 156 and 156' and 157 and 157' are damaged and do not work properly for guiding the hoist 150, and the hoist 150 is slanted in the direction of one side of the girder 160, it contacts with a corresponding end of the second girder and supports the same, so that the hoist 150 is prevented from being escaped from the girder 160.

INDUSTRIAL APPLICABILITY

As described above, a buckling phenomenon does not occur at the girder even when a relatively heavy object is transferred by providing the first and second support wheel parts on the first vertical surface of the girder, and even when an impact load is transferred to the hoist frame owing to a swing operation of the weight object, the equal distribution unit properly absorbs the impact load and offsets the same for thereby equally distributing the entire vertical load, so that the driving efficiency of the hoist is significantly enhanced, and the hoist is prevented from being escaped from the guide rail. In addition, since the entire sizes and weight of the hoist frame are significantly decreased, it is possible to enhance the hoisting weight as weight as the decreased weight of the hoist. Since the hoist is supported by three points with the helps of the first and second front support wheel parts, and the rear support wheel part, the girder and the hoist mounted thereon can be most stably supported usin at least number of the support wheel parts.

Sequence Listing hoist, wheel, low space crane, girder, guide rail, hinge, connection plate, load point

The invention claimed is:

1. A hoist for a low space crane comprising:

a hoist frame having a wire drum;

first and second support plates attached to the wire drum and forming a structure of the hoist frame;

a girder having a rectangular cross-section wherein the rectangular cross-section is formed of first and second horizontal surfaces and first and second vertical surfaces;

a guide rail mounted vertically above the first vertical surface of the girder such that an impact load applied to the guide rail is distributed on the cross sectional area of the first vertical surface of the girder; and first and second equal distribution units, wherein the first and second support plates are respectively mounted on the first and second equal distribution units, wherein each equal distribution unit has first and second load support rollers mounted above the guide rail and is configured to move the hoist frame along a length of the guide rail such that an impact load applied to the hoist frame is distributed on the guide rail and the cross sectional area of the first vertical surface of the girder, wherein said first and second equal distribution units comprise:

first and second support pins which are fixed at lower sides of the first and second support plates; and first and second load support wheel parts which are mounted on the guide rail and move along the guide rail, with lower sides of the first and second support pins being mounted thereon and being roll-contact with the guide rail, wherein said first and second load support wheel parts comprise:

first and second bodies which have first and second insertion grooves at the center portions of the first and second bodies for mounting the first and second support plates thereon, and first and second spherical grooves formed in lower sides of the first and second insertion grooves so that the first and second contact parts of the first and second support pins roll-contact with the first and second spherical grooves; and wherein the first and second load support rollers are engaged with the first and second bodies and are mounted on the guide rail and run along the guide rail, wherein the hoist further comprises:

first and second support bolts which are engaged with the first and second bodies, and of which the ends are supported by the first and second support plates, so that a constant interval is maintained between the first and second insertion grooves and the first and second support plates.

2. The hoist of claim 1, wherein:

the first and second support plates are provided at both sides of the wire drum; and the hoist frame further comprises:

a drum cover which is connected with a corresponding end of each of the first and second support plates and covers the surrounding portions of the wire drum;

a connection plate which is connected with a corresponding other end of each of the first and second support plates and is provided with a rear support wheel part for riding on the rear side of the girder; and first and second reinforcing brackets which are respectively fixed on one of the first and second support plates, and of which a lower end of each bracket is opposite to a front lower side of the girder, and first and second front support wheel parts supported by the front side of the girder are installed at the lower side of a respective one of the first and second reinforcing brackets.

3. The hoist of claim 2, wherein said rear support wheel part is supported by a rear upper side of the girder, and the first and second front support wheel parts are supported by the front lower side of the girder, so that the hoist frame is supported by three points of the girder.

4. The hoist of claim 3, wherein said rear support wheel part comprises:

a first rear support wheel part which consists of a first piece in which a pair of first rear rollers are supported by the rear side of the girder and the first rear rollers are hinged;

a second rear support wheel part which consists of a second piece in which a pair of second rear rollers are supported by a rear side of the girder and the second rear rollers are hinged;

an engaging plate in which the first and second rear support wheel parts are hinged at opposite ends of the engaging plate; and a hinge shaft which is engaged with the engaging plate and the connection plate, respectively.

5. The hoist of claim 2, wherein said rear support wheel part comprises:

a first rear support wheel part which consists of a first piece in which a pair of first rear rollers are supported by the rear side of the girder and the first rear rollers are hinged;

a second rear support wheel part which consists of a second piece in which a pair of second rear rollers are supported by a rear side of the girder and the second rear rollers are hinged;

an engaging plate in which the first and second rear support wheel parts are hinged at opposite ends of the engaging plate; and a hinge shaft which is engaged with the engaging plate and the connection plate, respectively.

6. The hoist of claim 2, wherein said first and second equal distribution units comprise:

first and second support pins which are fixed at the lower sides of the first and second support plates; and first and second load support wheel parts which are mounted on the guide rail and move along the same, with lower sides of the first and second support pins being mounted thereon and being roll-contact with the same.

7. The hoist of claim 1, wherein said first and second support pins comprise:

first and second support parts having first and second slots which are inserted into lower sides of the first and second support plates, respectively, and first and second spherical contact parts which are formed at lower sides of the first and second support parts.

8. The hoist of claim 1, wherein:

the first and second support plates arc are provided at both sides of the wire drum and have first and second front guide wheels; and the hoist frame further comprises:

a drum cover which is connected with a corresponding end of each of the first and second support plates and covers the surrounding portions of the wire drum; and a connection plate which is connected with a corresponding other end of each of the first and second support plates and has a rear support wheel part supported by a rear side of the girder.

9. The hoist of claim 8, wherein said first and second support plates each further comprise a falling down protector for preventing the hoist from being escaped from the girder by supplementing the first and second front guide wheels.

* * * * *